US009486754B2

(12) United States Patent
Foldesi, Jr. et al.

(10) Patent No.: US 9,486,754 B2
(45) Date of Patent: Nov. 8, 2016

(54) WINE AND LIQUOR AERATOR FITMENT

(71) Applicants: Steve Foldesi, Jr., Hinesburg, VT (US); Tito Yuri Romero, Laval (CA)

(72) Inventors: Steve Foldesi, Jr., Hinesburg, VT (US); Tito Yuri Romero, Laval (CA)

( * ) Notice: Subject to any disclaimer, the term of this patent is extended or adjusted under 35 U.S.C. 154(b) by 32 days.

(21) Appl. No.: 14/413,674

(22) PCT Filed: Jul. 8, 2013

(86) PCT No.: PCT/US2013/049527
§ 371 (c)(1),
(2) Date: Jan. 8, 2015

(87) PCT Pub. No.: WO2014/011523
PCT Pub. Date: Jan. 16, 2014

(65) Prior Publication Data

US 2015/0174537 A1 Jun. 25, 2015

Related U.S. Application Data

(60) Provisional application No. 61/669,264, filed on Jul. 9, 2012, provisional application No. 61/716,533, filed on Oct. 20, 2012.

(51) Int. Cl.
*B01F 3/04* (2006.01)
*B01F 5/04* (2006.01)

(52) U.S. Cl.
CPC ..... *B01F 3/04787* (2013.01); *B01F 3/04007* (2013.01); *B01F 3/0446* (2013.01); *B01F 3/04099* (2013.01); *B01F 3/04794* (2013.01); *B01F 5/0428* (2013.01); *B01F 2215/0072* (2013.01)

(58) Field of Classification Search
CPC .. B01F 3/04; B01F 3/04007; B01F 3/04099; B01F 3/0446; B01F 3/04787; B01F 3/04794
USPC ..... 261/78.2, DIG. 75; 99/323.1
See application file for complete search history.

(56) References Cited

U.S. PATENT DOCUMENTS

2012/0074092 A1 3/2012 Devoy
2012/0156345 A1 6/2012 Agarwal

FOREIGN PATENT DOCUMENTS

FR 2 682 085 A1 4/1993

*Primary Examiner* — Robert A Hopkins
(74) *Attorney, Agent, or Firm* — James Marc Leas

(57) ABSTRACT

An aerating system includes a container, a liquid, and a venturi tube. The liquid is inside the container. The container includes a dispensing port for dispensing the liquid. The dispensing port includes the venturi tube. The venturi tube is positioned so liquid being dispensed through the dispensing port flows through the venturi tube. The venturi tube includes a portion that includes an air-access port. The air access port is located to draw air into the venturi tube when the liquid is dispensed through the venturi tube. The portion of the venturi tube that includes the air-access port is located inside the container.

26 Claims, 20 Drawing Sheets

Section A-A

Section B-B

Section A-A

Section B-B

WINE AND LIQUOR AERATOR FITMENT

FIELD

This patent application generally relates to a fitment for aerating a liquid, such as wine or liquor, as it is poured from a bottle or from another container.

BACKGROUND

Pour spouts with aerators are presently available to enhance properties of wine by infusing air with the wine as it is being poured. In embodiments of U.S. design Pat. Nos. D614,443 and D624,358, a portion of the aerator is inserted into the neck of the bottle by the consumer while a portion of the aerator remains external to the bottle. Air enters the aerator and the aeration occurs in the portion of the aerator that remains external to the bottle. Other aeration devices have been marketed that are entirely external to the bottle. These require the user to pour the wine or other liquid into the separate aeration device.

However, all the previous aeration devices on the market have been costly add-ons for use in conjunction with an ordinary wine bottle. Thus, further improvement is desired to gain the advantages of aeration while avoiding this problem, and this solution is provided by the following.

SUMMARY

1. One aspect of the present patent application is an aerating system that includes a container, a liquid, and a venturi tube. The liquid is inside the container. The container includes a dispensing port for dispensing the liquid. The dispensing port includes the venturi tube. The venturi tube is positioned so liquid being dispensed through the dispensing port flows through the venturi tube. The venturi tube includes a portion that includes an air-access port. The air access port is located to draw air into the venturi tube when the liquid is dispensed through the venturi tube. The portion of the venturi tube that includes the air-access port is located inside the container.
2. The aerating system as recited in paragraph 1 or the method as recited in paragraph 21, wherein the dispensing port includes an aerator fitment, wherein the venturi tube is included in the aerator fitment, wherein the aerator fitment is mechanically held in the dispensing port to provide the flow through the venturi tube.
3. The aerating system as recited in paragraph 2 or the method as recited in paragraph 21, wherein the venturi tube is integrated with the aerator fitment.
4. The aerating system as recited in paragraph 2 or 3 or the method as recited in paragraph 21, wherein the aerator fitment is friction fit into the dispensing port.
5. The aerating system as recited in any of paragraphs 1-4 and 6-19 or the method as recited in paragraph 21, further comprising a make-up path for allowing make-up air from outside the container to access the air-access port inside the container.
6. The aerating system as recited in paragraph 5 or the method as recited in paragraph 21, wherein the make-up air path includes a make-up air port and a cavity, wherein the make-up air port is located to allow air from outside the container to enter the cavity, wherein the cavity extends between the make-up air port and the air-access port.
7. The aerating system as recited in paragraph 6 or the method as recited in paragraph 21, wherein the aerator fitment includes an upper flange, wherein the make-up air port is shaped to allow air to pass the upper flange.

8. The aerating system as recited in paragraph 7 or the method as recited in paragraph 21, wherein the upper flange includes lugs that extend to the inner wall, wherein the make-up air port is located between the lugs.
9. The aerating system as recited in paragraph 6, 7, or 8 or the method as recited in paragraph 21, further comprising a vacuum avoiding port, wherein the vacuum avoiding port is located to allow air from the cavity to replace the liquid in the container as the liquid flows out through the venturi tube in the dispensing port.
10. The aerating system as recited in paragraph 9 or the method as recited in paragraph 21, wherein the aerator fitment includes a lower flange, wherein the vacuum avoiding port is configured to allow air to pass the lower flange.
11. The aerating system as recited in paragraph 10 or the method as recited in paragraph 21, wherein the vacuum avoiding port includes a hole in the lower flange to allow air to pass the lower flange.
12. The aerating system as recited in paragraph 10 or 11 or the method as recited in paragraph 21, wherein the lower flange includes extensions.
13. The aerating system as recited in any of paragraph 2-12 or 20 or any combination of paragraphs 2-12 or 20 or the method as recited in paragraph 21, further comprising a closure, wherein the closure is connected to close the dispensing port, wherein the aerator fitment is connected to the closure before the closure is removed from the dispensing port for the first time.
14. The aerating system as recited in paragraph 13 or the method as recited in paragraph 21, wherein the container includes threads, wherein the closure includes a screw top for connecting to the container.
15. The aerating system as recited in any of paragraph 2-14 or 17-20 or any combination of paragraphs 2-14 or the method as recited in paragraph 21, wherein the container is a bottle having a bottle neck, and wherein the aerator fitment is friction fit in the bottle neck.
16. The aerating system as recited in any of paragraphs 1-15 or 17-20 or in any combination of paragraphs 1-15 or 17-20 or the method as recited in paragraph 21, wherein the liquid includes one from the group consisting of wine and liquor.
17. Another aspect is an aerating system that includes a container. The container contains a liquid and an aerator-closure combination uni. The aerator-closure combination unit includes an aerator fitment and a closure.
18. The aerating system as recited in paragraph 17, wherein the aerator fitment includes a friction fitting member, wherein the friction fitting member is connected to the closure before the closure is removed from the bottle for the first time.
19. The aerating system as recited in paragraph 17, wherein the friction fitting member includes at least one from the group consisting of a flange and a fin.
20. Another aspect is an aerating system that includes a container. The container contains a liquid and an aerating fitment element. The aerating fitment element includes a portion that provides air for aerating the liquid when the liquid is dispensed. The portion is fully inside the container. The air is provided to the portion during the aerating that extends along a make-up path. The make-up path originates in a make-up port positioned to allow outside air to enter the container.

21. Another aspect is a method of fabricating an aerating system. The method includes:
   a. providing a container having a dispensing port for dispensing the liquid;
   b. providing a liquid inside the container;
   c. providing a venturi tube, wherein the venturi tube includes a portion that includes an air-access port, wherein the air access port is located to draw air into the venturi tube when a liquid flows through the venturi tube; and
   d. positioning the venturi tube in the dispensing port of the container so liquid being dispensed through the dispensing port flows through the venturi tube, wherein the portion of the venturi tube that includes the air-access port is located inside the container.
22. Another aspect is a method of using an aerating system. The method includes:
   a. providing a container holding a liquid, an internal aerating device, and a closure, wherein the internal aerating device has a portion for aerating the liquid while the liquid is being poured out of the container, wherein the aerating portion is fully inside the container, wherein the closure covers the internal aerating device and closes the container; and
   b. removing the closure, wherein the removing the closure leaves the internal aerating device inside the container; and
   c. pouring and aerating the liquid during the pouring.
23. Another aspect is a bottle of wine that includes wine, a bottle, a closure, and an aerator fitment.

When the closure is connected to close the bottle, the wine and the entire aerator fitment are enclosed within.

24. An aerating system as recited in paragraph 23, wherein the bottle has a rim, wherein the aerator fitment has an upper flange, wherein the upper flange extends between the rim and the closure, wherein all portions of the aerator fitment other than the upper flange are within the bottle.
25. An aerating system as recited in paragraph 23, wherein the entire aerator fitment is within the bottle.
26. An aerating system as recited in any of paragraphs 23-25, wherein the bottle includes a neck, wherein the aerator fitment is tight press fit within the neck.
27. An aerating system as recited in any of paragraphs 23-26, wherein the closure includes a screw thread for connecting the closure to the bottle.
28. An aerating system as recited in paragraph 23-27, wherein the aerator fitment includes a venturi tube, wherein the venturi tube includes a portion that includes an air-access port, wherein the air access port is located to draw air into the venturi tube when the wine flows through the venturi tube.
29. An aerating system as recited in paragraphs 23-27, wherein the aerator fitment includes a vacuum avoiding port.
30. An aerating system as recited in paragraphs 10 and 23-27, or the method as recited in paragraph 21, wherein the vacuum avoiding port includes a vent tube.
31. An aerating system as recited in paragraphs 1-20, wherein the entire aerator fitment is within the container.
32. An method as recited in paragraphs 21 and 22, wherein the entire internal aerating device is within the container.
33. The aerating system as recited in paragraph 1 or the method as recited in paragraph 21, further comprising a barrel, wherein the venturi tube is in the barrel, wherein the dispensing port includes a narrowed region, wherein the barrel is friction fit within the narrowed region.

BRIEF DESCRIPTION OF THE DRAWINGS

FIGS. 2*a*-2*b* are a three dimensional views of an aerator fitment of FIG. 1*a;*

FIG. 4 is a three dimensional exterior view of the closure and bottle of FIG. 3*a* with cap on;

DETAILED DESCRIPTION

Figure 1A:
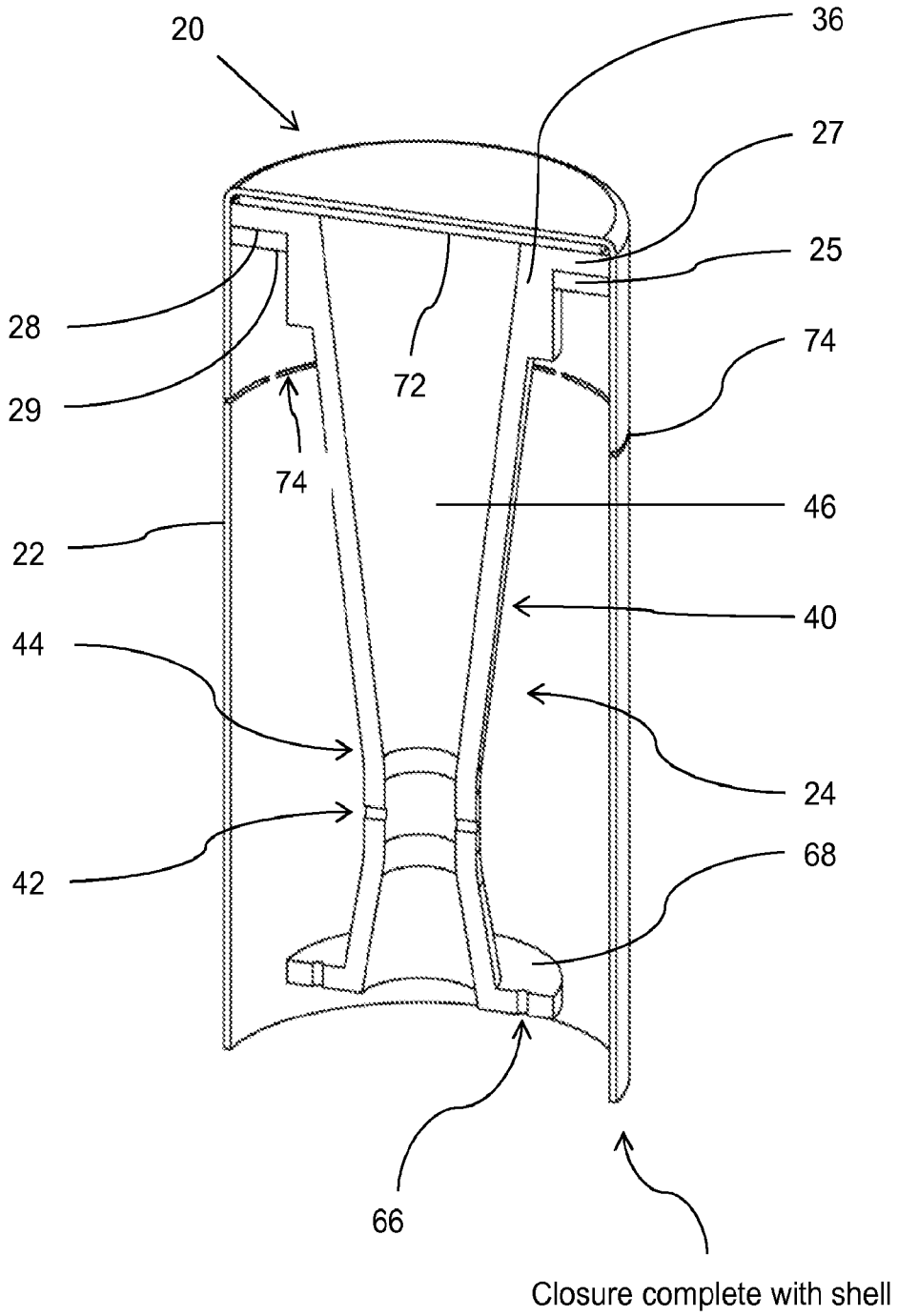
FIG. 1*a* is a three dimensional view of an aerator fitment and a closure.
Figure 1B:
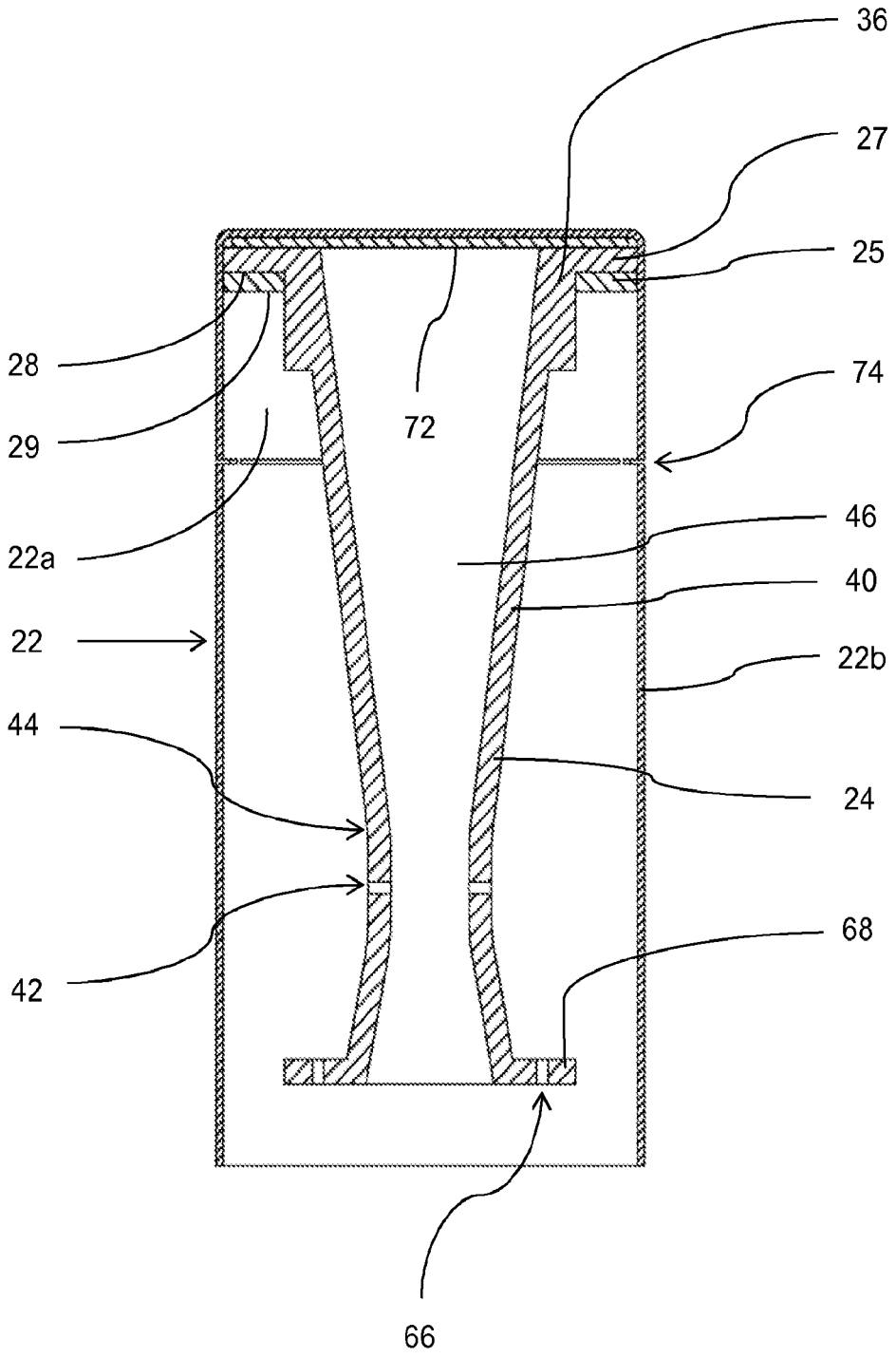
FIGS. 1*b*-1*c* are a cross sectional views of the aerator fitment and closure of FIG. 1*a;*
Figure 1C:
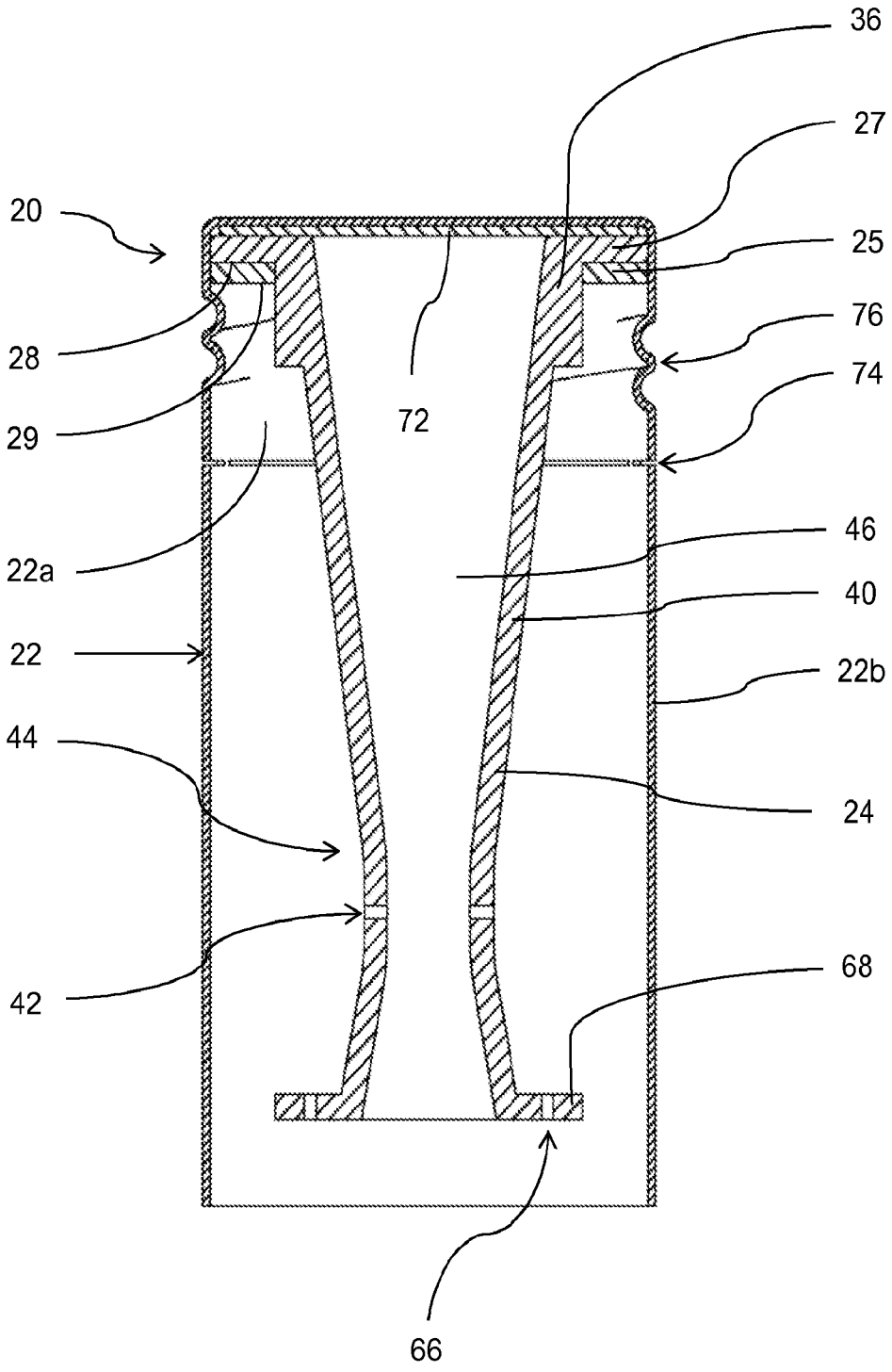
Figure 1D:
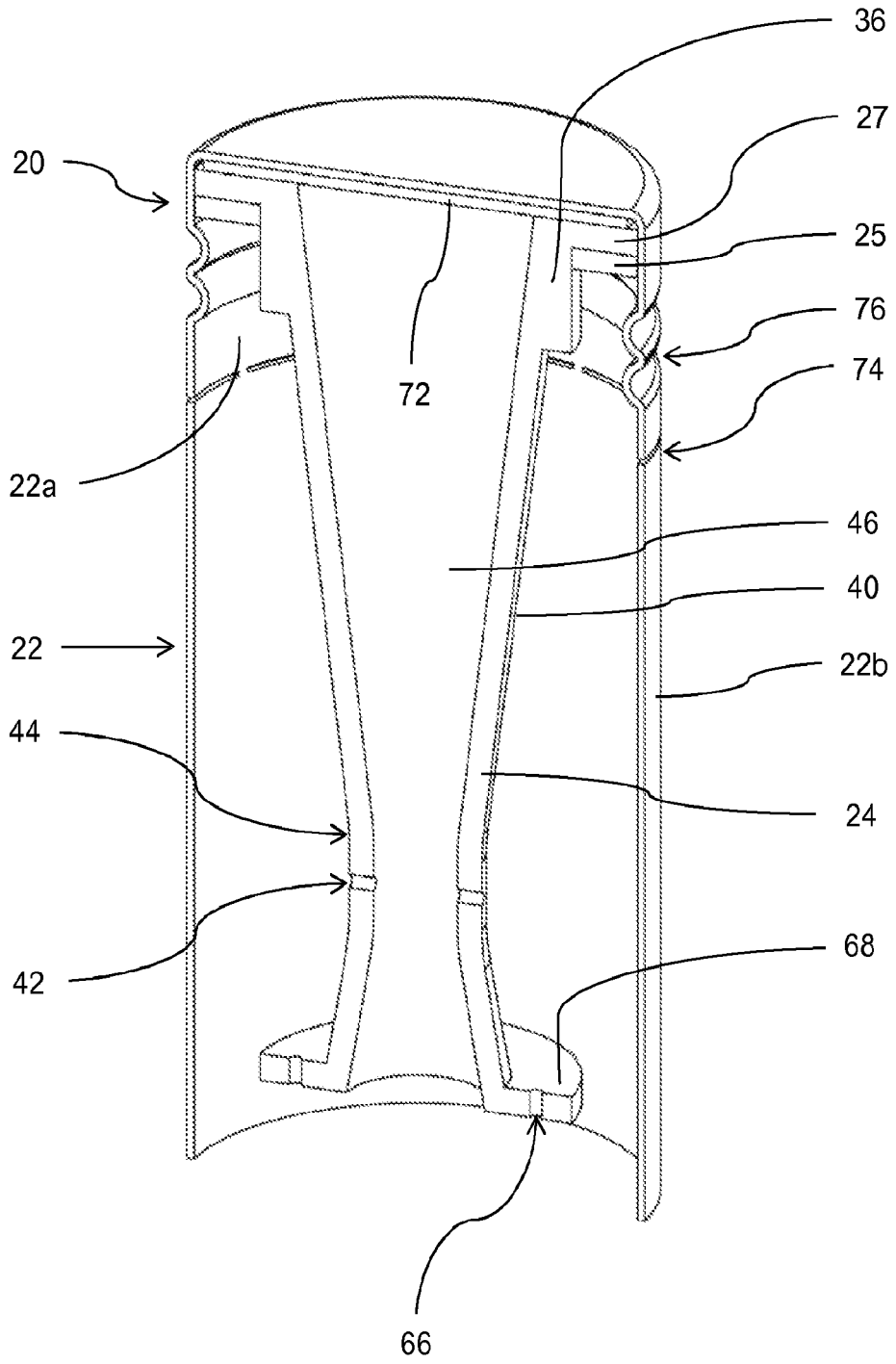
FIG. 1*d* is a three dimensional view of the aerator fitment and closure of FIG. 1*a;*
Figure 2A:
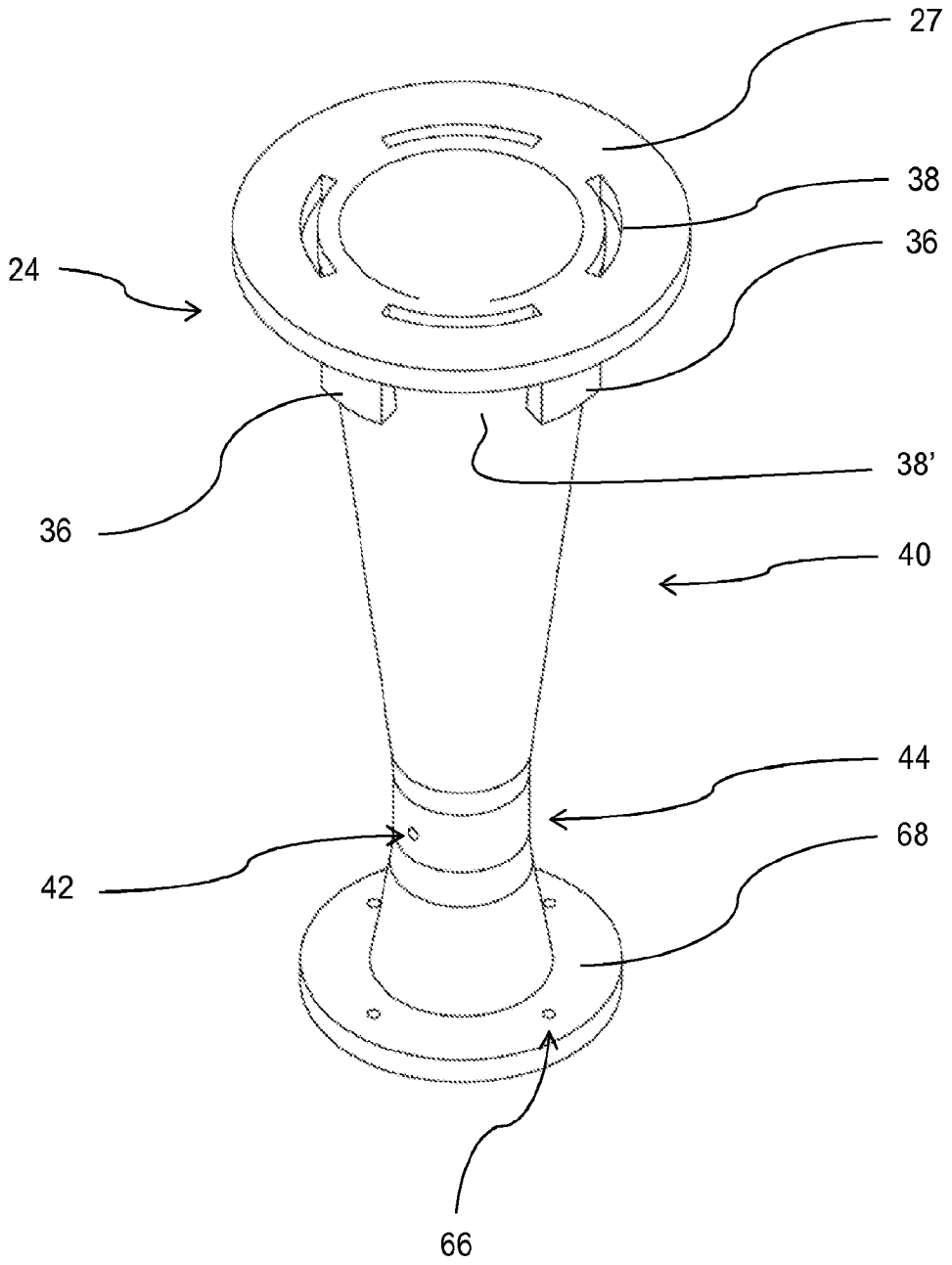
Figure 5B:
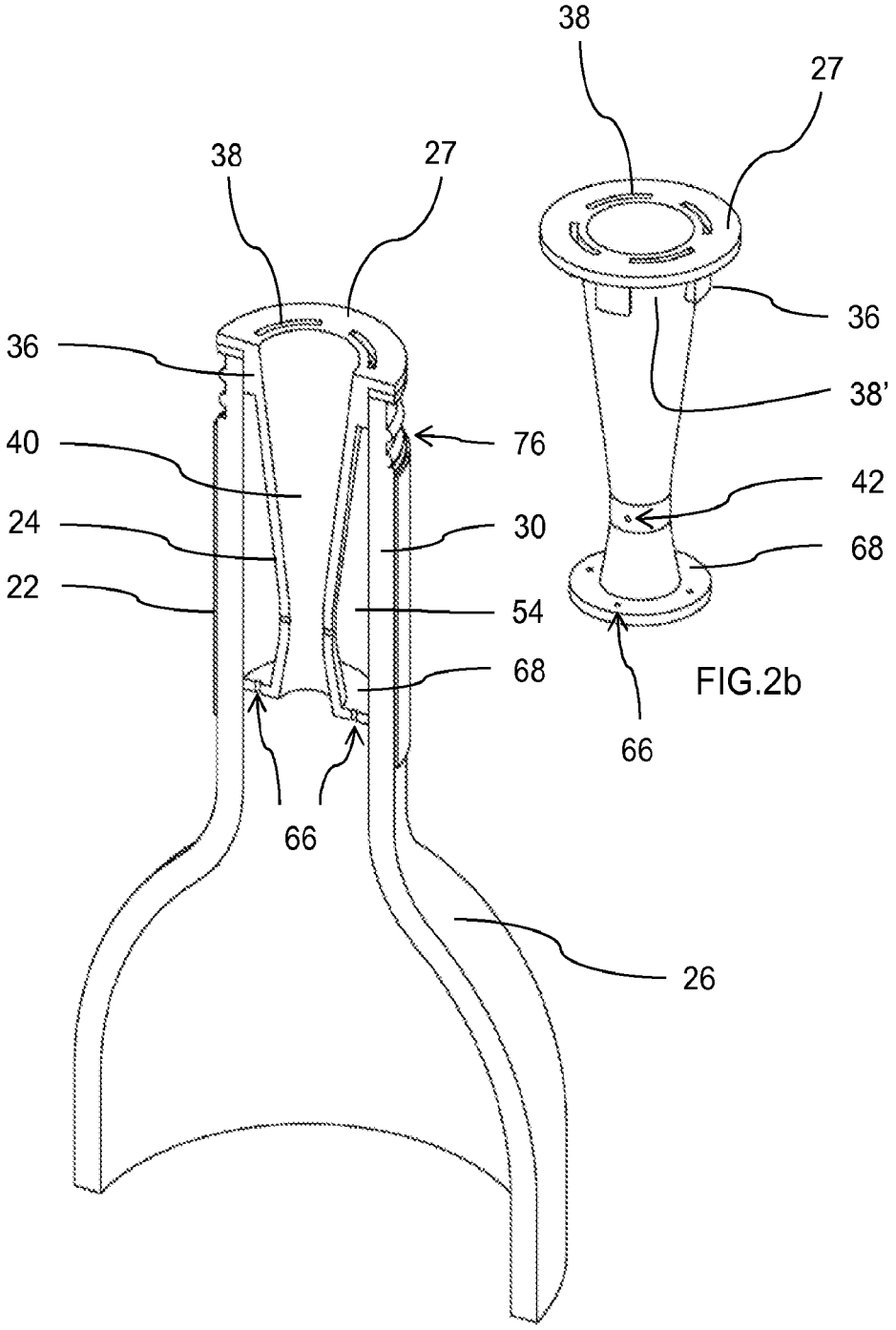
FIG. 5*b* is a three dimensional cutaway view of the aerator fitment, closure, and bottle of FIG. 5*a* with cap off.

The present applicants found that they could mount an aerator fitment fully into a dispensing port of a container, such as the opening of a wine or liquor bottle that is closed with an ordinary screw cap. They found that this aerator fitment could be included in each such bottle at very little cost. They also found that the aerator fitment could be mounted into dispensing ports of other types of bottles and other types of containers, such as box-type liquid containers, as well.

In one embodiment, aerator-closure combination unit 20 includes screw top closure shell 22 and aerator fitment 24, as shown in FIGS. 1, 3*a*-3*b*, 4, 5*a*-5*b*. In this embodiment, aerator fitment 24 and an optional foam liner 25 are temporarily included within screw top closure shell 22 for bottle 26. In one embodiment, the three parts are fabricated separately. Then foam liner 25 is placed in aerator fitment 24 and aerator fitment 24 with foam liner 25 are connected to screw top closure shell 22, such as with a friction fit or with crimping. The friction fit may be accomplished with a structure, such as an oversized flange or with fins, as described herein below. Screw top closure shell 22 includes screw top closure cap 22*a* and screw top closure shell 22*b*.

One embodiment of the friction fit that includes an oversized flange has oversized upper flange 27 of aerator fitment 24 along with foam liner 25 pushed into screw top closure shell 22 and held in place by the resulting friction. The over sizing may be in the range of 5 to 10 thousandths of an inch to produce the desired tight press fit.

For the crimping, upper flange 27 with foam liner 25 goes into screw top closure shell 22 loosely and then a tool is used to form an edge in the soft aluminum of screw top closure cap 22*a* to hold upper flange 27 in place.

In one embodiment, aerator fitment 24 is formed by injection molding plastic. Plastics, such as low density polyethylene, polypropylene, or polystyrene can be used. Plastics, such as high density polyethylene can also be used.

Foam liner 25 is optionally used to seal any gaps that could otherwise exist between lower surface 28 of upper flange 27 of aerator fitment 24 and top edge 29 of bottle 26. Top edge 29 of bottle 26 may have a slightly irregular surface, such as if fabricated of glass. However, for bottles, such as plastic bottles, where top edge 29 is sufficiently regular, foam liner 25 may still be included or it may be omitted.

Foam liner 25 is ring shaped and has an inside diameter equal to the inside diameter of neck 30 of bottle 26. In one embodiment, foam liner 25 is placed and held by friction on lower surface 28 of upper flange 27 before upper flange 27 is inserted in screw top closure shell 22. In another embodiment, a process, such as the welding technique described in commonly assigned U.S. Pat. No. 8,101,041, "Method to improve adhesion of a formed gasket to plastic closures," incorporated herein by reference, is used to adhere foam liner 25 to lower surface 28 of upper flange 27 before upper flange 27 is inserted in screw top closure shell 22.

In the embodiment with aerator-closure combination unit 20, most of aerator fitment 24 is press fitted into neck 30 of bottle 26 when screw top closure 22 is applied to bottle 26, as shown in FIGS. 3*a*-3*b* and 5*a*-5*b*. Upper flange 27 of aerator fitment 24 extends over top edge 29 of neck 30 of bottle 26, as shown in FIGS. 1, 3*a*-3*b*, 5*a*-5*b*, and 6*a*-6*c*.

Aerator-closure combination unit 20 with its flanged aerator fitment 24 connected to closure 22 can be attached to bottle 26 in a single operation to both insert aerator fitment 24 into neck 30 of bottle 26 and apply connected screw top closure 22, upper flange 27, and foam liner 25 on top edge 29 and around neck 30 of bottle 26. Aerator fitment 24 is held in neck 30 of bottle 26 by the pressure fit of lugs 36 to inner wall 31 of neck 30 between slots 38, 38'.

When screw top closure 22 is later unscrewed and removed from bottle 26 to enable pouring the wine, as shown in FIGS. 5*a*-5*b*, 6*a*-6*c*, and 6*e*, aerator fitment 24 becomes separated from screw top closure 22 and remains in neck 30 of bottle 26 as a result of the pressure fit of lugs 36 to inner wall 31.

Figure 7A:
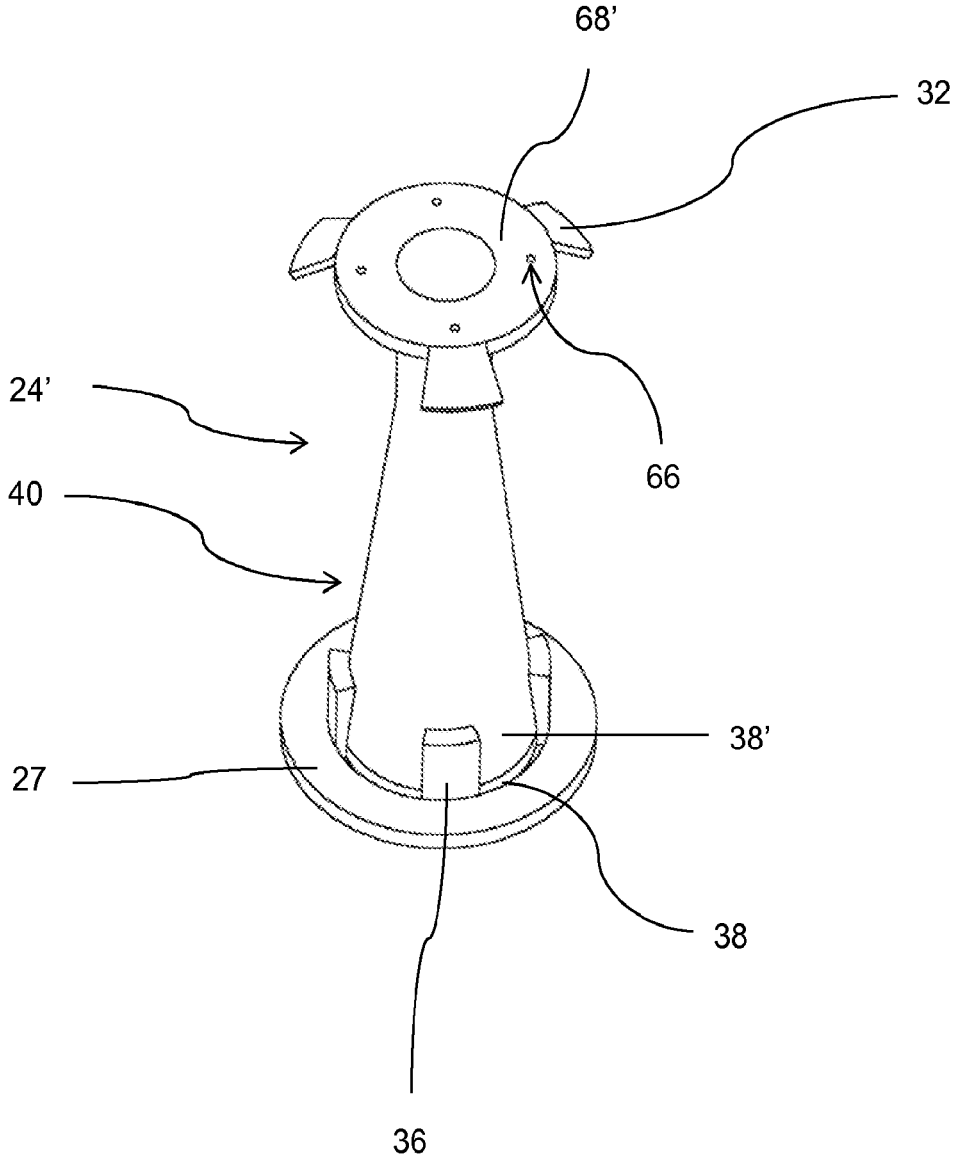
FIG. 7*a* is a three dimensional view of another embodiment of an aerator fitment.
Figure 7B:
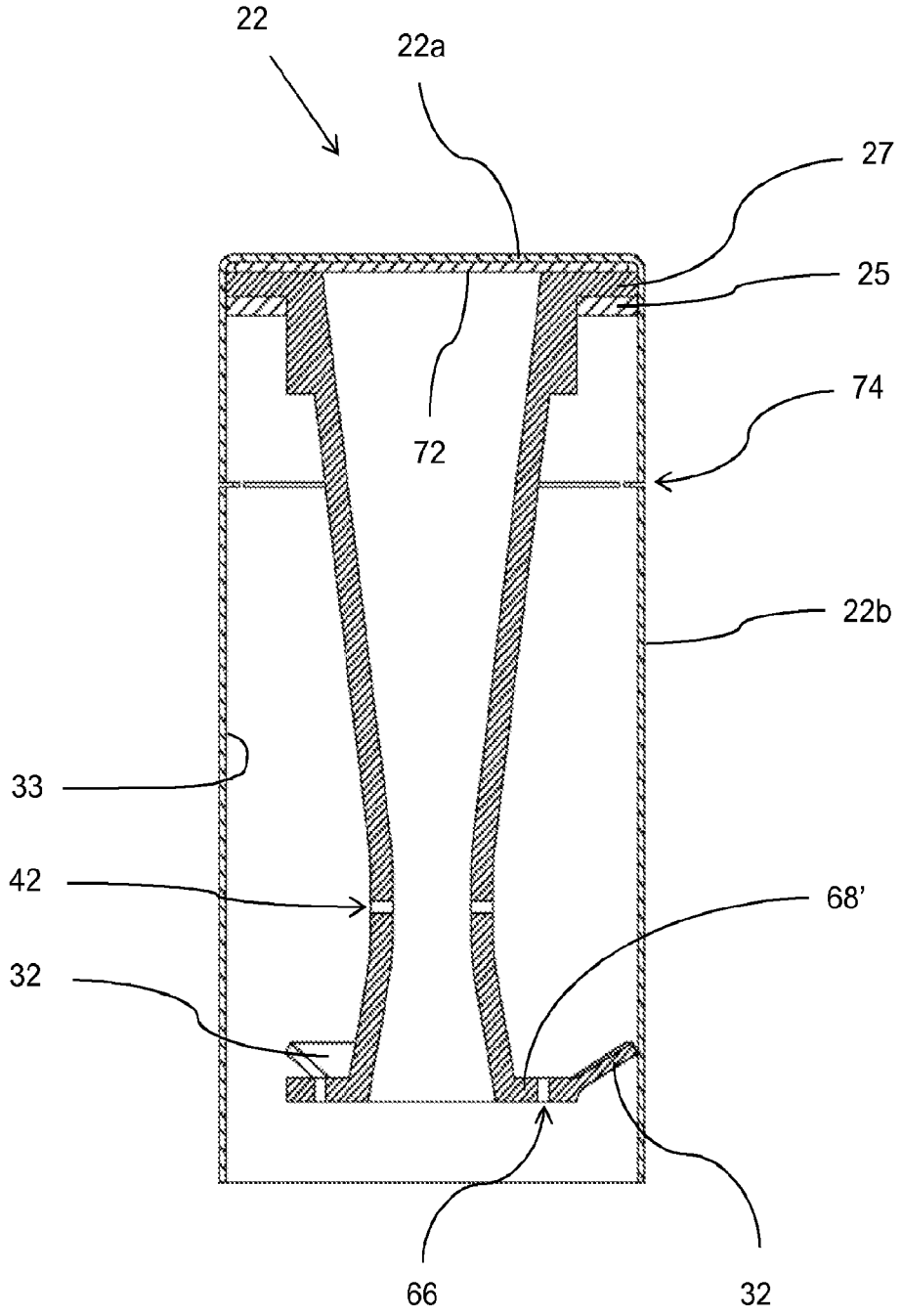
FIGS. 7*b*-7*c* are cross sectional views of the aerator fitment of FIG. 7*a* and a closure.
Figure 7C:
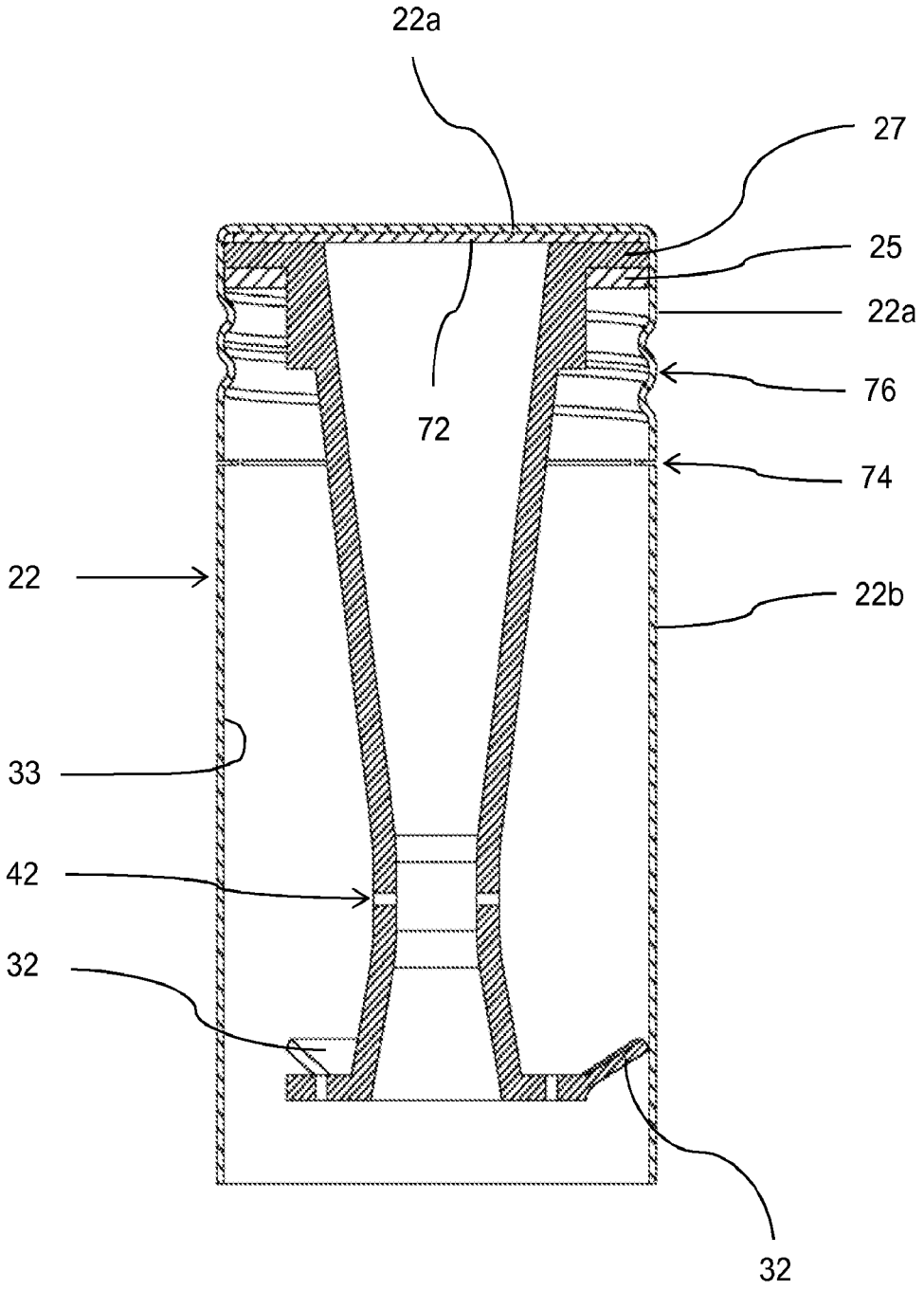

In another embodiment, the friction fit between aerator fitment and closure is accomplished with extensions, such as fins 32 provided on lower flange 68' of aerator fitment 24', as shown in the bottom view of FIG. 7*a* and in FIGS. 7*b*-7*c*. Fins 32 press against inner sidewalls 33 of screw top closure shell 22*b* during insertion of aerator fitment 24' into screw top closure 22 and prevent aerator fitment 24' from falling out even if aerator fitment 24' is not friction fitted into cap 22. Thus, fins 32 provide an alternative to the friction fit and crimping and the looser fit allows easier removal of screw top closure cap 22*a* from bottle 26. In pressing aerator fitment 24' into screw top closure shell 22*b* a cylindrical tool (not shown) with cylindrical levels that presses both on lower flange 68' and on fins 32 is used to provide fins 32 tilted as shown in FIGS. 7*b* and 7*c*.

Figures 8A, 8B, 8C:
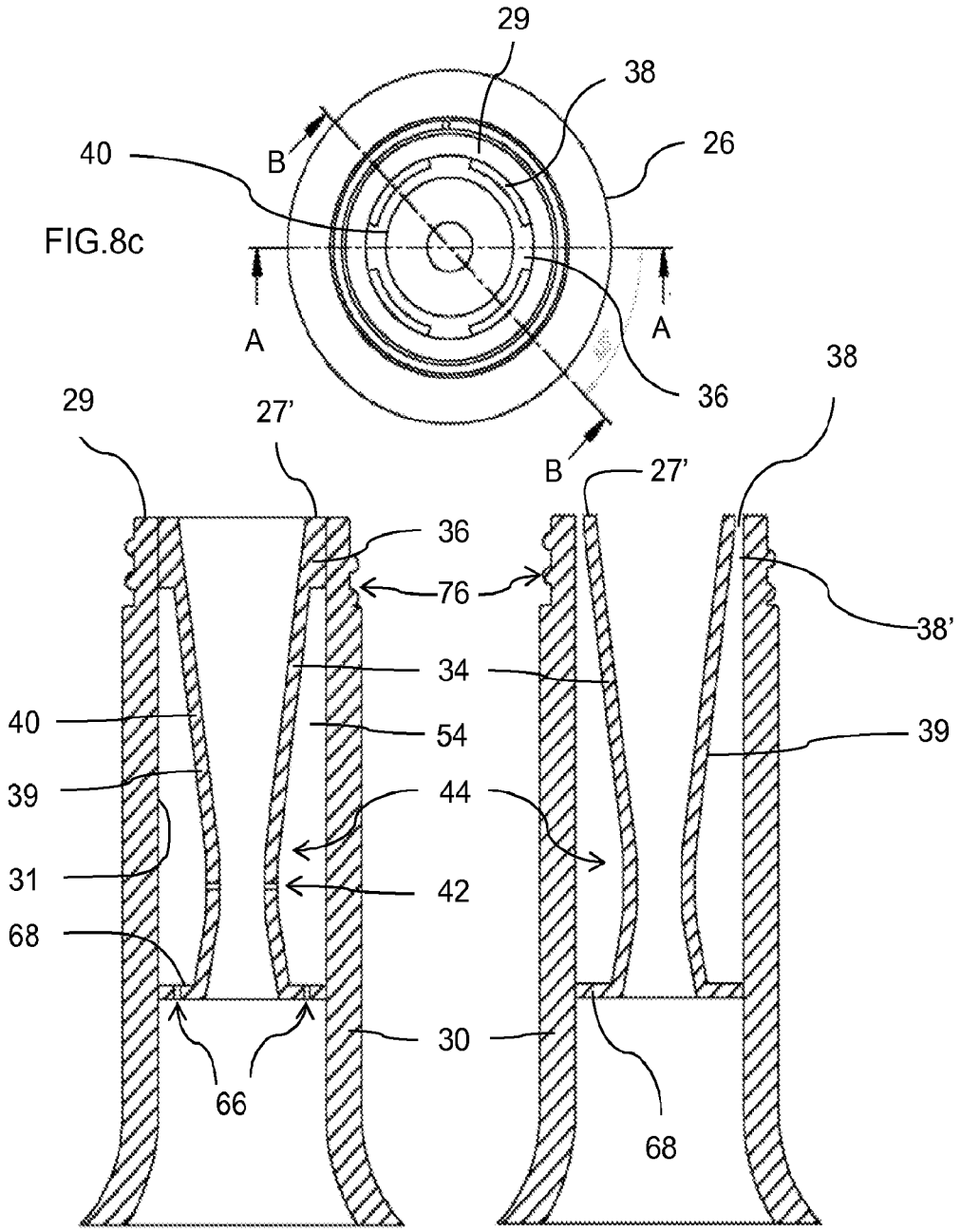
FIGS. 8*a*-8*b* are cross sectional views of another embodiment of an aerator fitment installed in a wine bottle.
FIG. 8*c* is a top view of the aerator fitment of FIGS. 8*a*-8*b;*

In another embodiment, aerator fitment 39 is inserted into neck 30 of bottle 26 prior to capping. In this embodiment aerator fitment 39 is not connected with a closure, and a separate closure (not shown) is later applied to bottle 26. Thus, upper flange 27 and foam liner 25 may be omitted, as shown in FIGS. 8*a*-8*c* and aerator fitment 39 is entirely inserted into bottle 26. As in the previously described embodiment in which aerator fitment 24 is connected to a closure before capping, aerator fitment 24, 39 is held in neck 30 of bottle 26 by the pressure fit of lugs 36 located between slots 38, 38' that are pressing against inner wall 31 of neck 30.

In each of these embodiments, aerator fitment 24, 39 uses venturi tube 40 that draws air through an air-access port, such as side hole 42, in its narrow part 44. Multiple side holes 42 can be included in narrow part 44. As the wine is poured out of bottle 26 through aerator fitment 24, 34 its flow rate increases as it flows through narrowest part 44 of venturi tube 40. The increased flow rate is associated with a decreased pressure in the liquid according to Bernoulli's principle. The decreased pressure in the liquid causes air to be drawn in through side holes 42, aerating the wine. In addition, in longer part 46 of venturi tube 40 between side holes 42 and top edge 29 of wine bottle 26 the flowing wine and air drawn in through side holes 42 tumble and mix together, further aerating the wine.

The air drawn in to venturi tube 40 through side holes 42 produces a distinct sound. This sound may convey to the user that the device is working. In addition, the user may be able to see bubbles flowing in the wine in longer part 46 of venturi tube 40.

Upper flange 27 or upper surface 27' includes an air make-up port, such as one or more slots 38, 38', that allow air from outside the bottle to enter into cavity 54 between venturi tube 40 and inner wall 31 of bottle 26. This make-up path for external air to enter through slots 38 and into cavity 54 is shown in the cross section of FIG. 6*b* and in the three-dimensional view of FIG. 6*c*. As air is drawn from cavity 54 into side holes 42 in venturi tube 40 when wine is poured, an equal amount of make-up air is drawn in through slots 38, 38' into cavity 54 to make up for the air flowing into side holes 42.

Slots 38, 38' also supply air through cavity 54 into bottle 26 below venturi tube 40 through a vacuum avoiding port, such as holes 66 in lower flange 68 to make up for the volume of wine poured, avoiding the vacuum that would otherwise be created in bottle 26, as shown in FIGS. 1, 2*a*-2*b*, 3*a*-3*b*, 5*b*, 6*a*, and 6*c*-6*d*.

In the embodiment with upper flange 27, slots 38, 38' extend between lugs 36 in upper flange 27. Lugs 36 may be both within upper flange 27 and extending below upper flange 27. In either the embodiment with upper flange 27 and the one without upper flange 27, lugs 36 are tightly fitting against inner wall 31 of neck 30 of bottle 26, holding aerator fitment 24, 39 from falling into or out of bottle 26.

In the embodiment in which aerator-closure combination unit 20 is assembled by mounting aerator fitment 24 within screw top closure shell 22, liner 72 may be provided between upper flange 27 of aerator fitment 24 and inner surface 72 of screw top closure shell 22, as also shown in FIG. 1. Liner 72 provides a seal against leaks when screw top closure shell 22 is screwed on bottle 26. It is held in place by a crease formed in screw top closure cap 22*a*.

Screw top closure shell 22 may be made from several materials including formed metal, rigid or heat shrinkable plastic, and thermoformed plastic. In one embodiment, screw top closure shell 22 includes encircling temper evident slitting 74, preformed threads 76, knurls, embossing, or an additional part to mask threads 76.

Figure 9A:
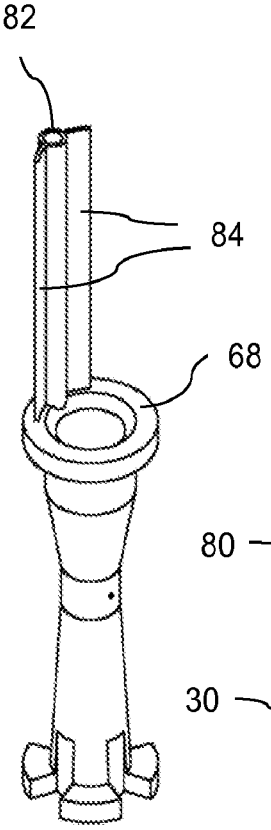
FIGS. 9*a* and 9*c* are bottom and top three dimensional views of another embodiment of an aerator fitment that has a vent tube.
Figure 9C:
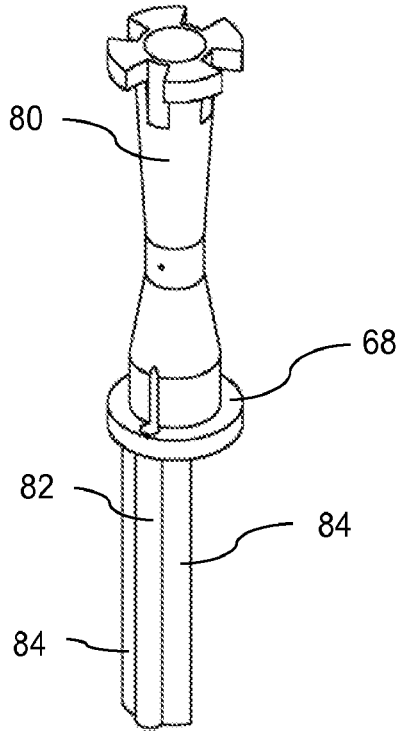
Figure 9B:
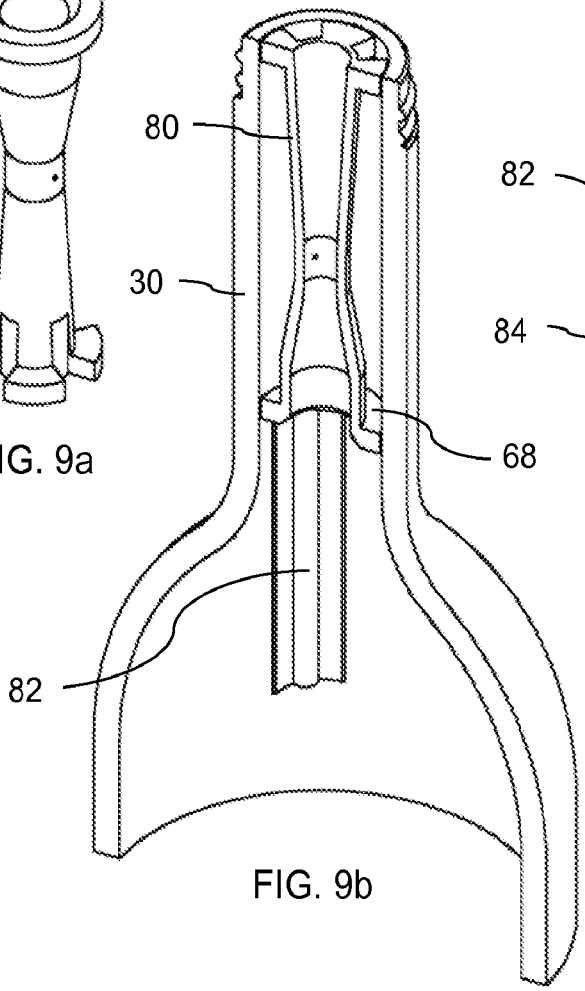
FIG. 9*b* is a three dimensional view of the aerator fitment of FIG. 9*a* installed in a wine bottle.

In one embodiment, aerator fitment 80 includes vent tube 82, as shown in FIGS. 9*a*-9*c*. Applicant found that vent tube 82 better allows make up air to enter the bottle as wine pours out than holes 66 in lower flange 68. In one embodiment tested by applicant, a vent tube that was 1.825 inches long provided good flow of wine. Applicant found that wine flow rate is higher as vent tube 82 is made longer. For example, vent tube can be 2 inches long or longer. Applicant also found that providing vent tube 82 with an inner diameter in the range of 0.125 inch provides good flow of wine. This inner diameter can be larger or smaller. In one prototype, the outer diameter of vent tube 82 was in the range of 0.165 inch.

Ribs 84 provide mechanical reinforcement to vent tube 82 to prevent breakage. In the prototype with vent tube 82, holes 66 shown in FIGS. 1*a*-1*d*, 2*a*-2*b*, 3*a*-3*b*, 5*b*, 6*a*, 6*c*-6*d*, 7*a*-7*c*, and 8*a* were eliminated.

Lower flange 68 makes a tight seal with bottle neck 30. Lower flange 68 may be slightly oversized compared with the inner diameter of bottle neck 30 to compensate for any outward taper in bottle neck 30. Seal is improved if lower flange 68 is fabricated of a material that is conforming, such as low density polyethylene, and aerator fitment 80 as a whole can be made of this same material.

Although shown without upper flange 27 in FIGS. 9*a*-9*c*, vent tube 82 can also be used with the embodiment having upper flange 27.

As mentioned herein above, aerator fitment 39 of FIGS. 8*a*-8*b* is entirely inserted into bottle 26. Similarly, aerator fitment 80 of FIGS. 9*a*-9*c* with vent tube 82 is entirely inserted into bottle 26. Because aerator fitment 39, 80 is entirely within bottle 26, standard methods of capping can continue to be used.

Figure 3A:
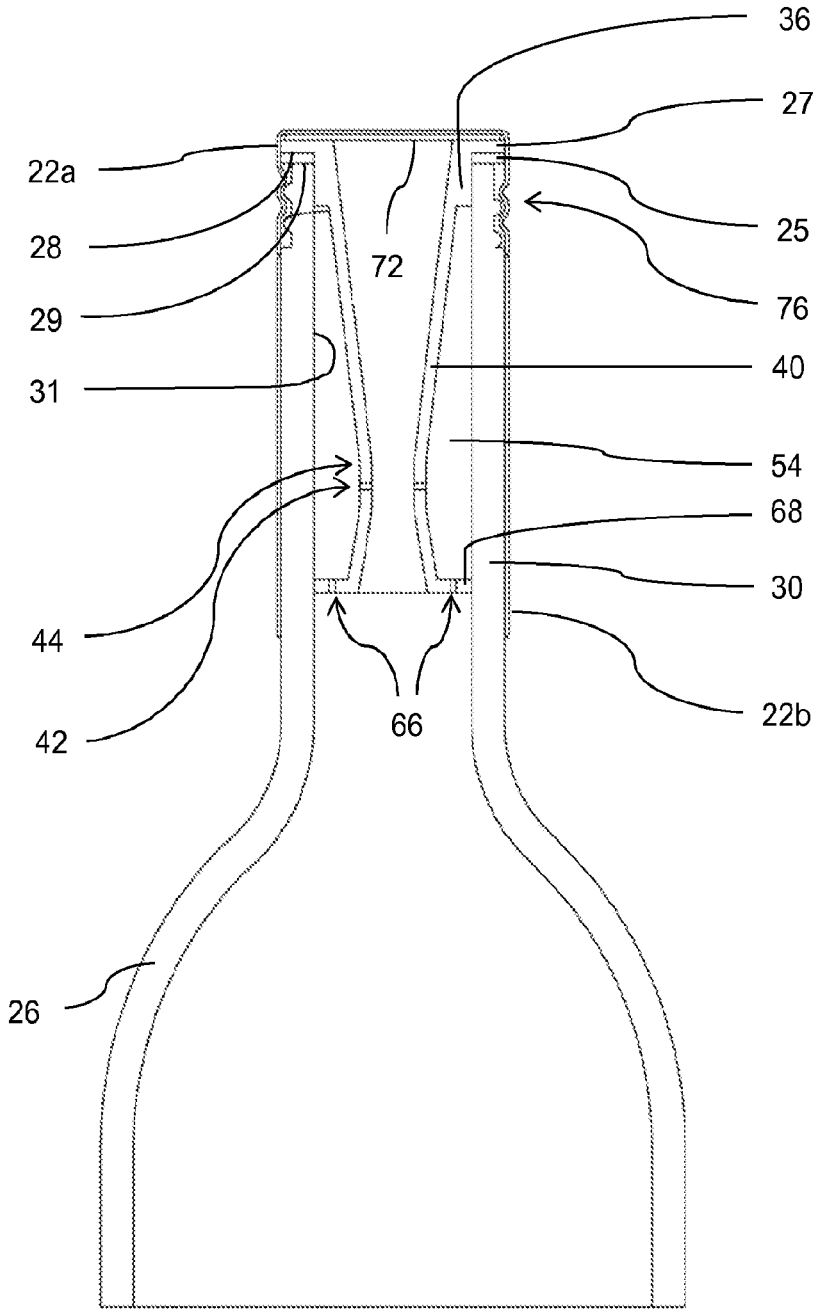
FIG. 3*a* is a cross sectional view of the aerator fitment of FIG. 1*a* installed in a wine bottle enclosed by the closure.
Figure 3B:
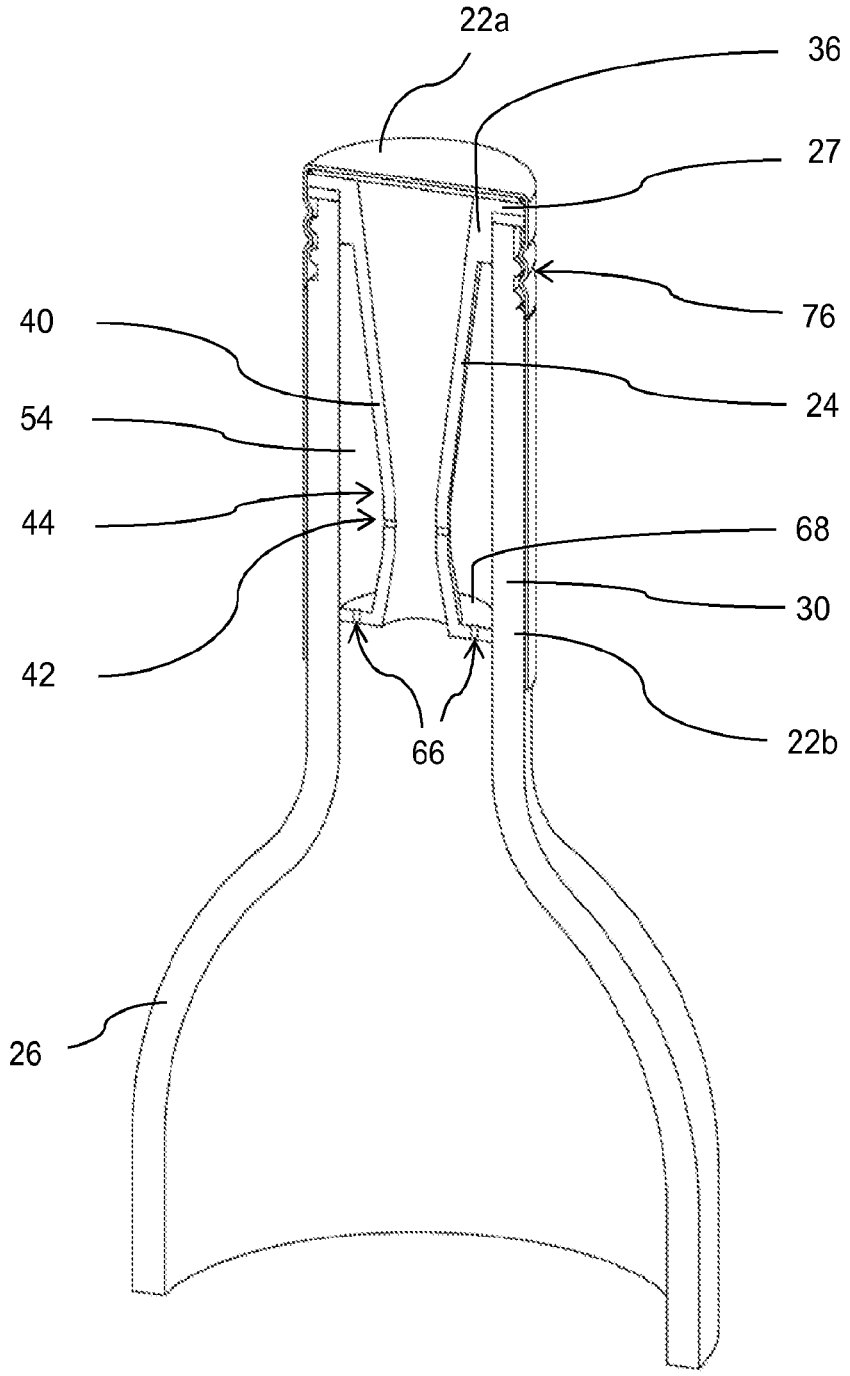
FIG. 3*b* is a three dimensional view of the aerator fitment, closure and bottle of FIG. 3*a;*
Figure 4:
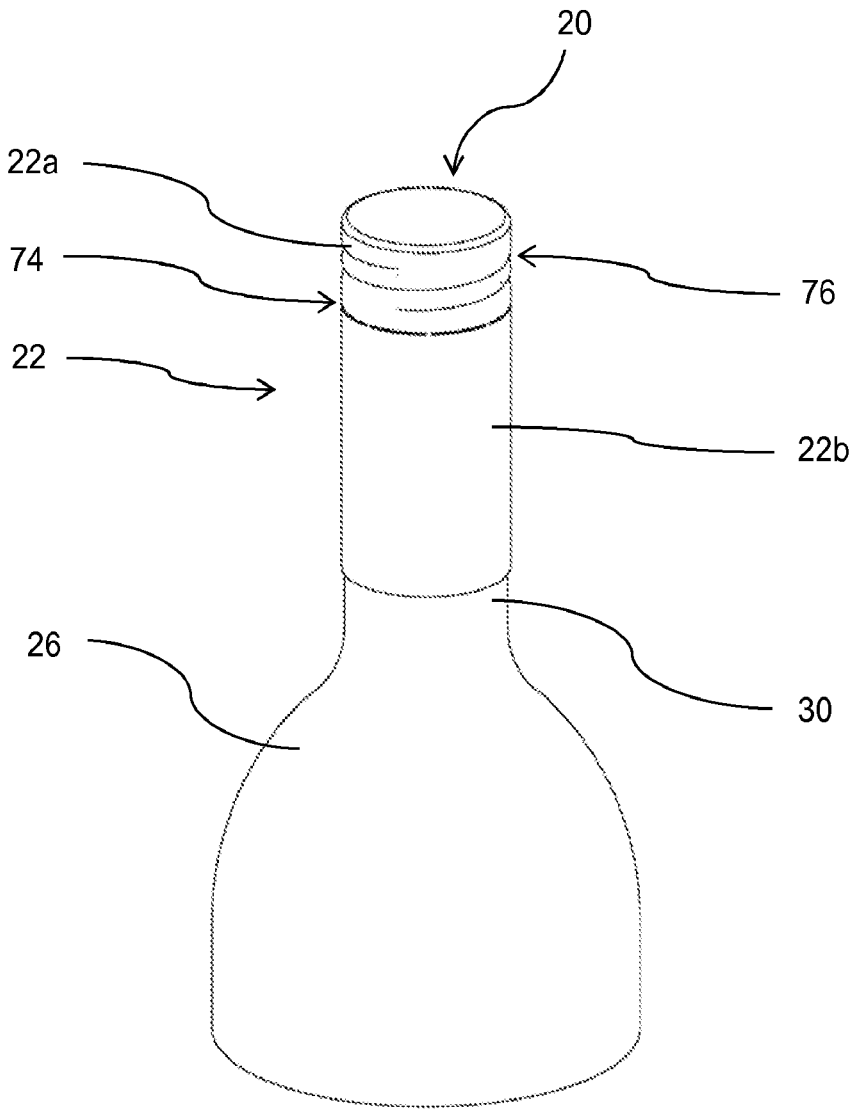
Figure 5A:
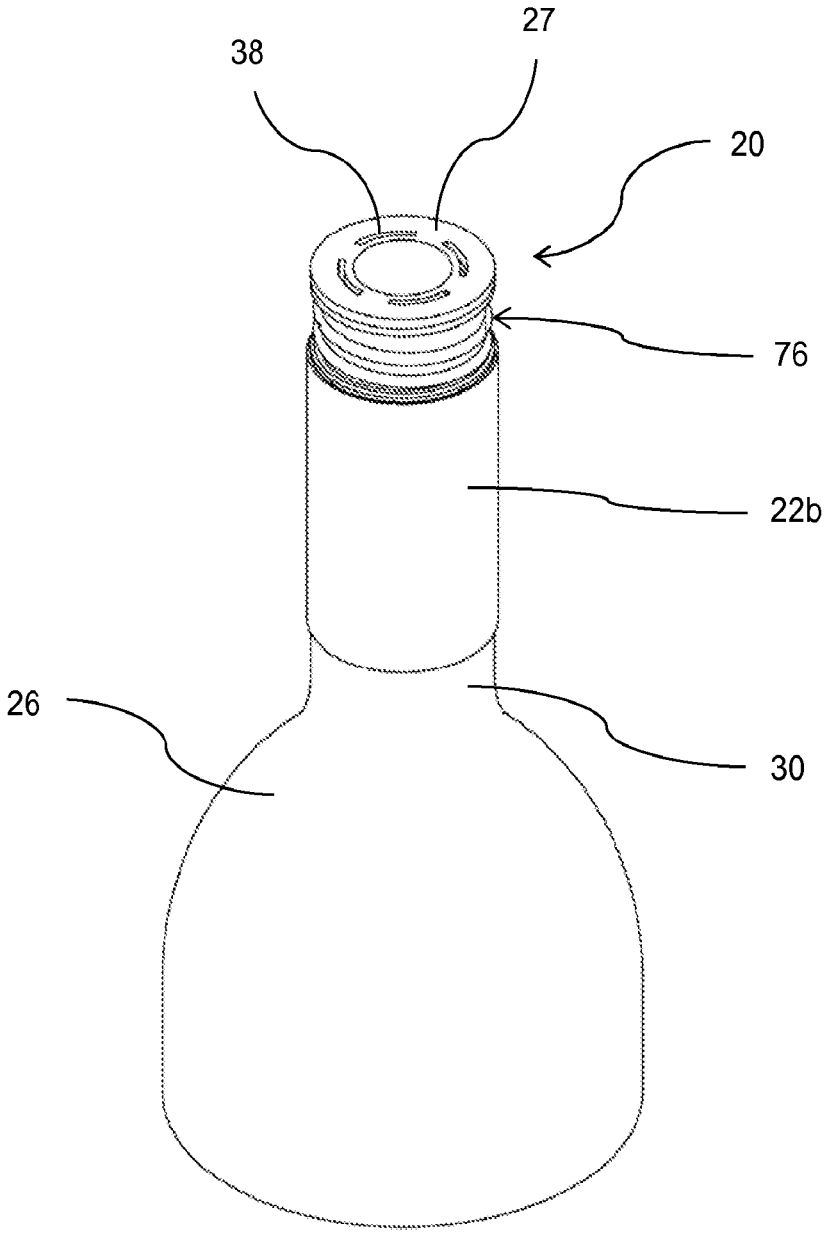
FIG. 5*a* is a three dimensional exterior view of the aerator fitment, closure, and bottle of FIG. 4 with cap off.
Figures 6A, 6B, 6E:
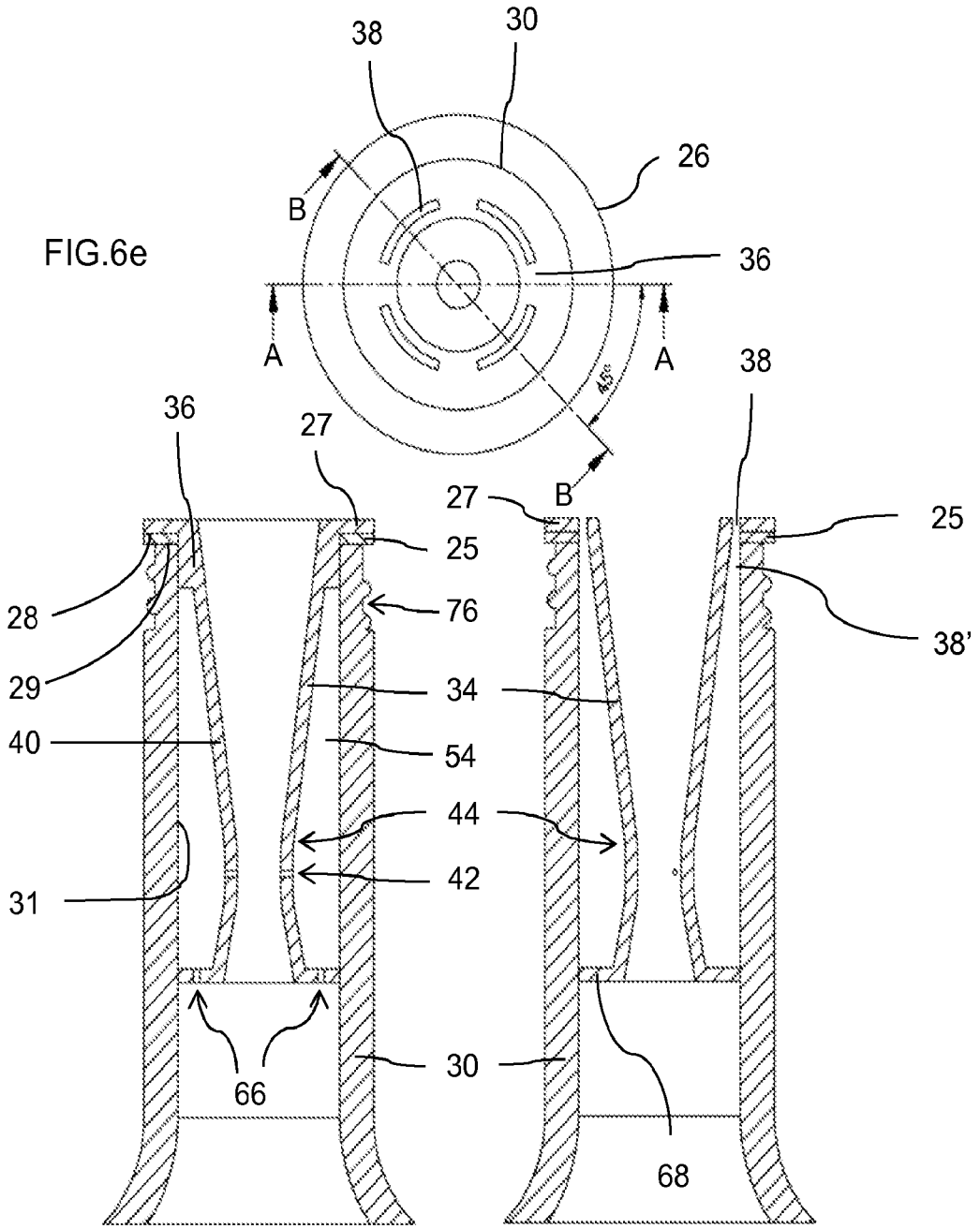
FIGS. 6*a*-6*b* are cross sectional views of another embodiment of an aerator fitment installed in a wine bottle.
FIGS. 6*d* and 6*e* are respectively a three dimensional view and a top view of the aerator fitment of FIGS. 6*a*-6*b;*
Figure 6C:
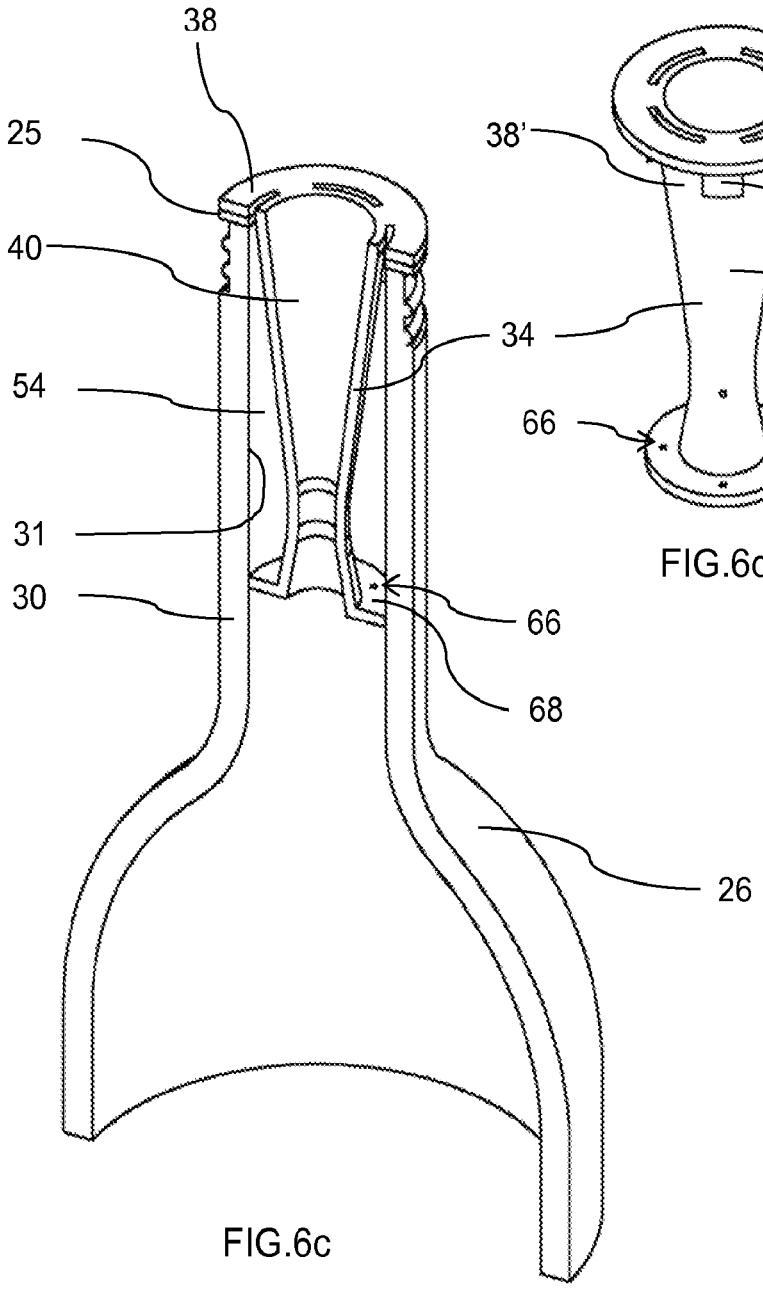
FIG. 6*c* is a three dimensional cutaway view of the aerator fitment installed in a wine bottle of FIGS. 6*a*-6*b;*
Figure 6D:
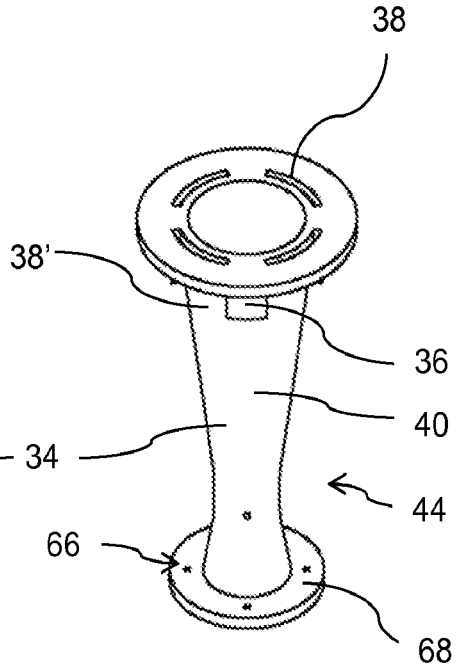

Also as previously described, upper flange 27 of aerator fitment 24 extends over top edge 29 of neck 30 of bottle 26, as shown in FIGS. 1, 31, 3*b*, 51-5*b*, and 6*a*-6*c*. In this embodiment all portions of aerator fitment other than upper flange 27 are located within bottle 26. Vent tube 82 can be included with the embodiment that has upper flange 27. When bottle 26 is closed with screw top closure 22*a*, aerator fitment 24, with or without vent tube 82 is entirely enclosed within bottle 26 and screw top closure cap 22*a*, as shown in FIGS. 3*a*-3*b*. Applicant found that standard methods of capping can continue to be used with the addition of optional foam liner 25 extending over top edge 29 of neck 30 of bottle 26, as shown in FIGS. 3*a*, 6*a*-6*c*, 7*b*-7*c*.

Figure 10A:
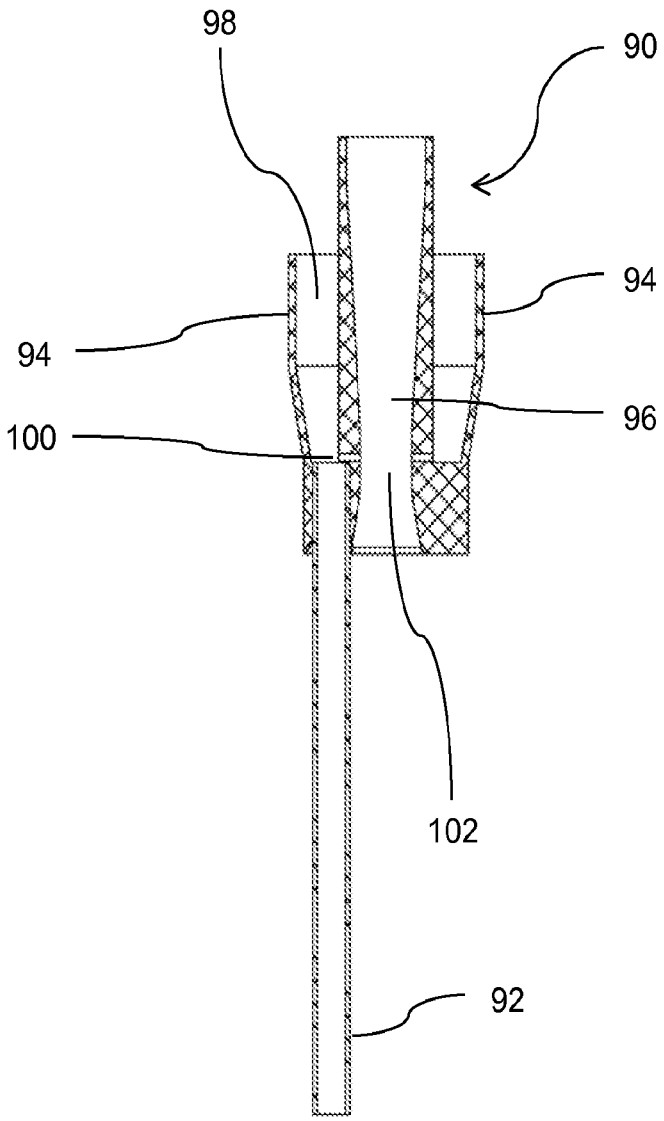
FIG. 10*a* is a cross sectional view of another embodiment of an aerator fitment with a vent tube.
Figure 10B:
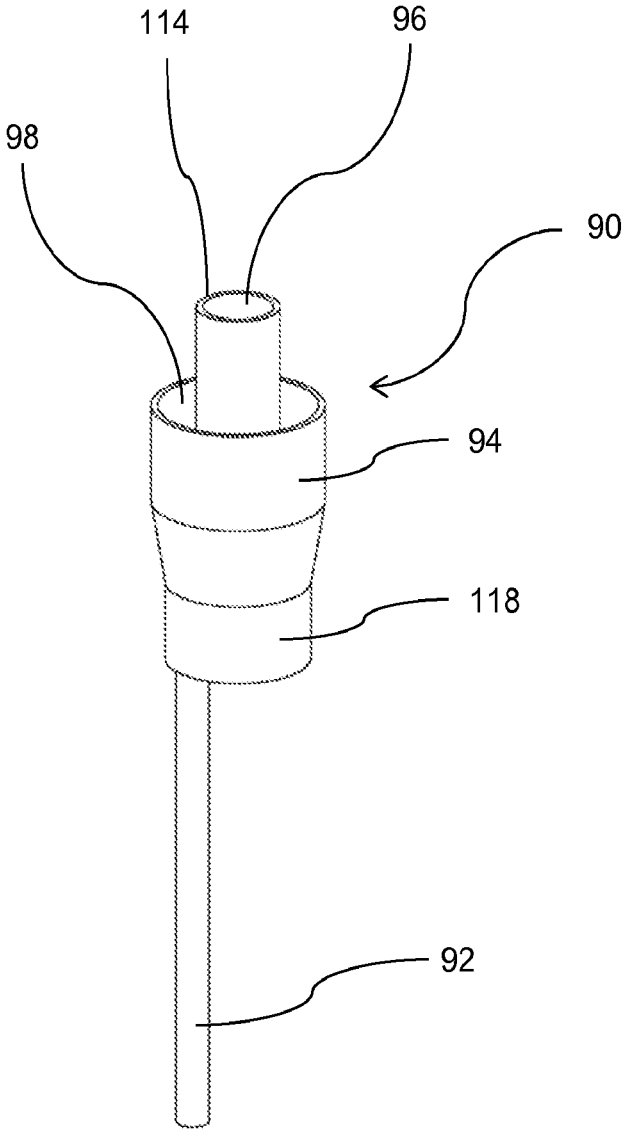
FIG. 10*b* is a three dimensional view of the aerator fitment of FIG. 10*a*.
Figure 10C:
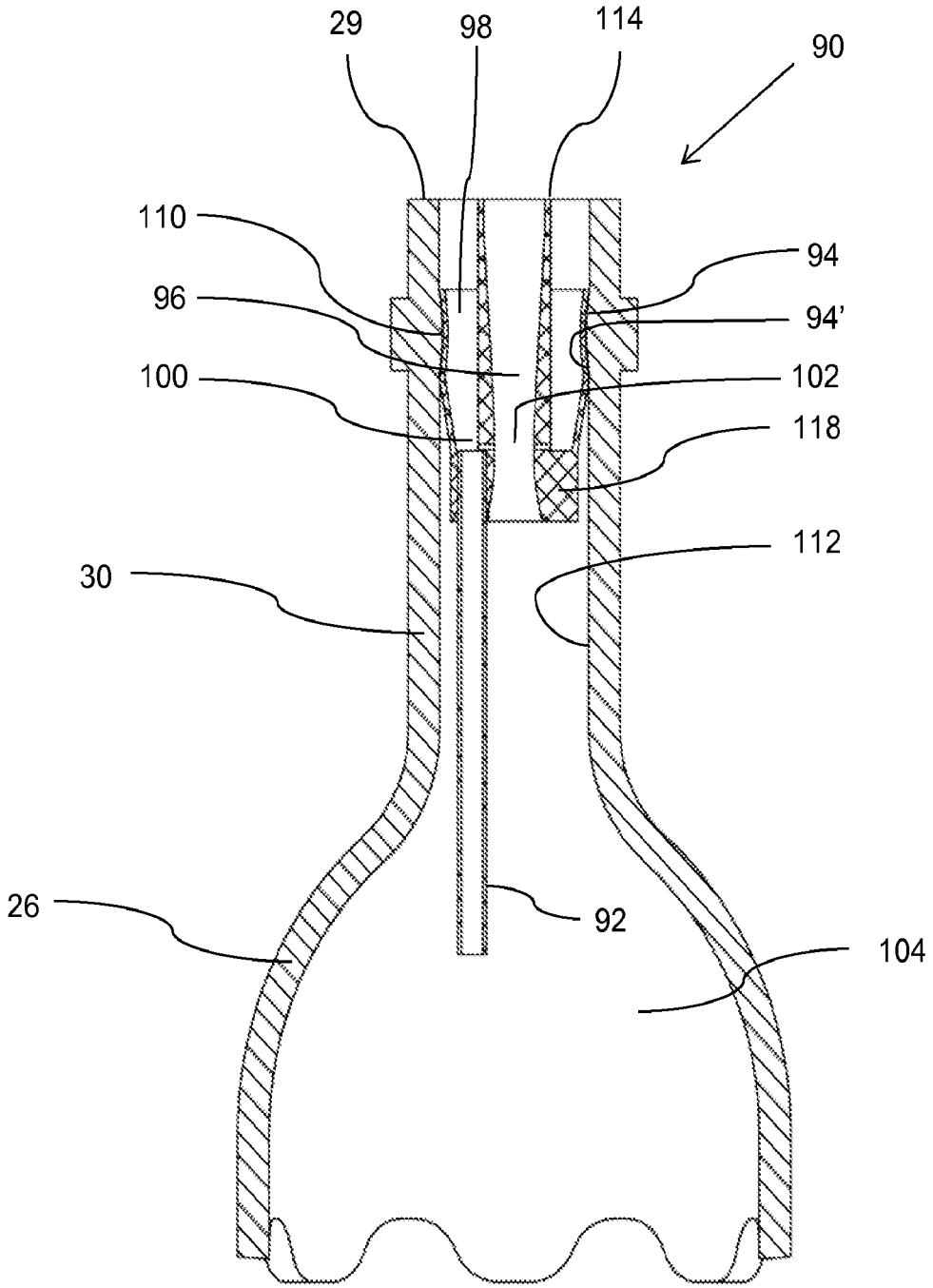
FIG. 10*c* is a cross sectional view of the aerator fitment of FIG. 10*a* installed in a wind bottle.

In another embodiment, aerator fitment 90 includes vent tube 92, compressible barrel 94, Venturi tube 96, air chamber cavity 98, and air access ports 100, as shown in FIG. 10*a*-10*b*. Air chamber cavity 98 extends between Venturi tube 96 and inner surface 94' of compressible barrel 94. Venturi tube 96 has narrowest part 102. Air access ports 100 connect air chamber cavity 98 with narrowest part 102 of Venturi tube 96. Air chamber 98 supplies make up air through vent tube 92 to interior 104 of wine bottle 26 as wine is poured out through Venturi tube 96, as shown in FIG. 10*c*. Air chamber cavity 98 also supplies make up air through air access ports 100 to narrowest part 102 of Venturi tube 96 as wine rushing out through Venturi tube 96 causes a lowered pressure in that region, drawing in air. The air entering narrowest part 102 of Venturi tube 96 causes bubbles in the wine and aerates the wine.

When inserted, compressible barrel 94 fits snugly in neck 30 of bottle 26, compressing or collapsing to form a tight fit against convex portion 110 of inside wall 112 of neck 30, as shown in FIG. 10*c*. The tight fit of barrel 94 against convex portion 110 prevents aerator fitment 90 from sliding up or down within neck 30 after insertion. Aerator fitment 90 may be inserted so that top edge 114 of venturi tube 96 extends to top edge 29 of bottle 26 while compressible barrel 94 extends somewhat lower inside neck 30.

Compressible barrel 94 and Venturi tube 96 with its air access ports 100 are formed as a single integral piece by injection molding. Vent tube 92 may be formed integral with barrel 94 and Venturi tube 96 in the injection molding step. Alternatively, vent tube 92 may be formed separately and later tight press fit into a hole extending through bottom portion 118 of compressible barrel 94 into air chamber cavity 98.

While several embodiments, together with modifications thereof, have been described in detail herein and illustrated in the accompanying drawings, it will be evident that various further modifications are possible without departing from the scope of the invention as defined in the appended claims. Nothing in the above specification is intended to limit the invention more narrowly than the appended claims. The examples given are intended only to be illustrative rather than exclusive.

The invention claimed is:

1. A device for aerating liquid while dispensing the liquid from a container that includes a dispensing port, wherein the dispensing port includes an inside wall, and wherein a closure is connectable to close the dispensing port, comprising an aerator fitment sized for tight press fit within the dispensing port, wherein when the aerator fitment is positioned within the inside wall of the dispensing port and when the closure is connected to close the dispensing port, the liquid and said entire aerator fitment are enclosed within the container and its closure, wherein said aerator fitment includes a venturi tube, a vacuum avoiding port, and a portion configured to make a seal with the inside wall of the dispensing port, wherein said venturi tube is positioned so liquid being dispensed through said dispensing port flows through said venturi tube, wherein said venturi tube includes a portion having an air-access port, wherein said air access port is located to draw air into said venturi tube when the liquid is dispensed through said venturi tube, wherein when said aerator fitment is located in the dispensing port, said portion of said venturi tube that includes said air-access port is located within the dispensing port, wherein said vacuum avoiding port includes a single vent tube.

2. The device as recited in claim 1, wherein said container has a rim, wherein said aerator fitment has an upper flange, wherein said upper flange extends between said rim and said closure, wherein all portions of said aerator fitment other than said upper flange are within said container.

3. The device as recited in claim 1, wherein said entire aerator fitment is within said container.

4. The device as recited in any of claim 1, wherein when the container includes a bottle having a neck, the dispensing port includes the neck, wherein said aerator fitment is sized for tight press fit within the neck.

5. The device as recited in any of claim 1, wherein said closure includes a screw thread for connecting said closure to said container.

6. The aerating system as recited in claim 4, wherein said portion configured to make a seal with the inside wall includes a barrel, wherein the neck has the inside wall, wherein when the inside wall has a convex portion, said barrel is sized for friction fit within the convex portion.

7. An aerating system as recited in claim 1, wherein said first portion includes at least one from the group consisting of an element sized for making said seal with the inside wall, an element fabricated of a conforming material for making an inside wall-conforming seal, a compressible portion configured to form a tight fit against the inside wall, and a collapsible portion configured to form a tight fit against the inside wall.

8. A device as recited in claim 1, wherein said single vent tube extends a distance of 2 inches or more.

9. A device for aerating liquid while dispensing the liquid from a container that includes a dispensing port, wherein the dispensing port includes an inside wall, comprising an aerator fitment, wherein said aerator fitment includes a venturi tube, a vacuum avoiding port, and a first portion configured to make a seal with said inside wall, wherein said venturi tube is positioned so liquid being dispensed through said dispensing port flows through said venturi tube, wherein said venturi tube includes a portion having an air-access port, wherein said air access port is located to draw air into said venturi tube when the liquid is dispensed through said venturi tube, wherein when said aerator fitment is located in the dispensing port, said portion of said venturi tube that includes said air-access port is located within said dispensing port, wherein said vacuum avoiding port includes a single vent tube.

10. The device as recited in claim 9, wherein said venturi tube is integrated with said aerator fitment.

11. The device as recited in claim 9, wherein said aerator fitment is friction fit into said dispensing port.

12. The device as recited in any of claim 9, further comprising a make-up path for allowing make-up air from outside said container to access said air-access port inside said container.

13. The device as recited in claim 12, wherein said make-up air path includes a make-up air port and a cavity, wherein said make-up air port is located to allow air from outside said container to enter said cavity, wherein said cavity extends between said make-up air port and said air-access port.

14. The device as recited in claim 13, wherein said aerator fitment includes an upper flange, wherein said make-up air port is shaped to allow air to pass said upper flange.

15. The device as recited in claim 14, wherein said upper flange includes lugs that extend to said inner wall, wherein said make-up air port is located between said lugs.

16. The device as recited in claim 13, wherein said vacuum avoiding port is located to allow air from said cavity to replace said liquid in said container as said liquid flows out through said venturi tube in said dispensing port.

17. The device as recited in claim 9, wherein said aerator fitment further includes a lower flange, wherein said vacuum avoiding port is configured to allow air to pass said lower flange.

18. The device as recited in claim 17, wherein said vacuum avoiding port includes a hole in said lower flange to allow air to pass said lower flange.

19. The device as recited in claim 18, wherein said lower flange includes extensions.

20. The device as recited in any of claim 9, further comprising a closure, wherein when said closure is configured for connection to close said dispensing port, wherein said aerator fitment is connected to said closure and is configured for separation from said closure when said closure is removed from said dispensing port for the first time.

21. The device as recited in claim 20, wherein said container includes threads, wherein said closure includes a screw top for connecting to said container.

22. The device as recited in any of claim 9, wherein when the container is a bottle having a bottle neck, the dispensing port includes the bottle neck, said aerator fitment is sized for friction fit in the bottle neck.

23. The device as recited in any of claim 9, wherein said aerator fitment is made of a material suitable for contact with a liquid that includes at least one from the group consisting of wine and liquor.

24. An aerating system, comprising a container, wherein said container contains a liquid and an aerator-closure combination unit, wherein said aerator-closure combination unit includes an aerator fitment and a closure, wherein said aerator fitment includes a friction fitting member, wherein said friction fitting member is connected to said closure before said closure is removed from said bottle for the first time.

25. The aerating system as recited in claim 24, wherein said friction fitting member includes at least one from the group consisting of a barrel, a flange and a fin.

26. An aerating system comprising a container, wherein said container includes a dispensing port, and wherein said container contains a liquid and an aerator fitment, wherein the dispensing port includes an inside wall, wherein said aerator fitment includes a vacuum avoiding port, a first portion configured to make a seal with said inside wall, and a second portion that provides air for aerating said liquid when said liquid is dispensed, wherein said second portion is fully inside said container, wherein said air provided to said second portion during said aerating is provided along a make-up path, wherein said make-up path originates in a make-up port positioned to allow outside air to enter said container, wherein said vacuum avoiding port includes a single vent tube.

* * * * *